US005579624A

United States Patent [19]

Aeberhard

[11] Patent Number: 5,579,624

[45] Date of Patent: Dec. 3, 1996

[54] PROFILE BAR FOR THE ATTACHMENT OF FLAT OBJECTS

[75] Inventor: Max Aeberhard, Andhausen/Berg, Switzerland

[73] Assignee: UL Tech AG, Berg, Switzerland

[21] Appl. No.: 438,657

[22] Filed: May 9, 1995

[30] Foreign Application Priority Data

May 16, 1994 [CH] Switzerland ..... 1516/94

[51] Int. Cl.[6] ..... E04C 3/00; E04B 2/00

[52] U.S. Cl. ..... 52/733.4; 52/235; 52/482; 52/762; 52/766; 52/773; 52/775; 52/780; 52/781; 52/731.2; 52/731.5

[58] Field of Search ..... 52/482, 235, 762, 52/766, 773, 775, 780, 781, 730.5, 731.5, 733.4, 733.1, 733.2, 774, 506.07, 506.08, 461, 730.5, 730.4, 731.2–731.4, 732.2

[56] References Cited

U.S. PATENT DOCUMENTS

| | | | |
|---|---|---|---|
| 2,023,047 | 12/1935 | Ganoe . | |
| 2,607,971 | 8/1952 | Bedford . | |
| 3,028,192 | 4/1962 | Jewell | 52/762 X |
| 3,822,522 | 7/1974 | Termohlen . | |
| 3,918,231 | 11/1975 | Kessler . | |
| 4,063,393 | 12/1977 | Toti . | |
| 4,332,119 | 6/1982 | Toews | 52/762 X |
| 4,344,267 | 8/1982 | Sukolics | 52/781 X |
| 4,453,363 | 6/1984 | Koller | 52/733.4 X |
| 4,506,484 | 3/1985 | Bartlett et al. | 52/762 X |
| 4,829,740 | 5/1989 | Hutchison | 52/762 |
| 5,263,292 | 11/1993 | Holland et al. | 52/775 X |

FOREIGN PATENT DOCUMENTS

| | | |
|---|---|---|
| 0121120 | 10/1984 | European Pat. Off. . |
| 2154242 | 5/1973 | France . |
| 1784142 | 8/1971 | Germany . |
| 413314 | 12/1966 | Switzerland . |
| 418587 | 2/1967 | Switzerland . |
| 2135355 | 8/1984 | United Kingdom . |

*Primary Examiner*—Robert J. Canfield
*Attorney, Agent, or Firm*—Marks & Murase L.L.P.

[57] ABSTRACT

The fastening device for objects, more particularly cladding panels or parts of apparatus, comprises a profile bar receiving the object to be fastened. The profile bar is essentially formed of a center profile and a respective adjacent lateral profile on both sides which are designed in such a manner that the center profile and one of the lateral profiles form a respective continuous clamping channel receiving a portion of the object to be fastened. This allows a very simple attachment of a variety of objects without any visible fastening elements.

19 Claims, 3 Drawing Sheets

PROFILE BAR FOR THE ATTACHMENT OF FLAT OBJECTS

BACKGROUND OF THE INVENTION

The present object refers to a profile bar for the attachment of flat objects, more particularly cladding panels, comprising a center profile and an adjacent lateral profile on each side thereof, the profiles being rigidly connected to each other and including two clamping channels between them and having clamping edges which are directed towards the inside of the clamping channels, the flat objects comprising side walls which are folded approximately perpendicularly and which are inserted in the clamping channels in an essentially straight manner and are maintained by the clamping edges.

A large number of fastening devices for the attachment of cladding panels are known, as well as a variety of fastening devices for the attachment of various casings and panellings to apparatus or similar constructions. Generally, such fastening devices are adapted to determined cladding panels or suitable for certain types of apparatus, while the fastening profiles are complicated in design and adapters are often needed for the attachment of objects.

A profile bar having two channels serving as a fastening device for panelling elements of a building is known from the document U.S. Pat. No. 3,822,522. This device is so designed that the clamping channels comprise clamping edges which face each other. The elements to be attached comprise side walls which are folded approximately perpendicularly and which are inserted in the clamping channels. The clamping edges thus fasten the elements, the elastic holding force being provided by a slight elastic deformation of the profile bar.

However, tolerance problems in the construction sector are too important, the elastic range of the profile bar is too small, and long-term material fatigue and alterations are too significant to allow a durable attachment in the described manner.

U.S. Pat. No. 4,332,119 describes a wall or panel connector. The panels therefor are provided with claw engaging means along two opposing edges which are engaged by being snapped into resilient claw ends. The panel connector has the shape of a profile bar comprising a center profile and two lateral profiles rigidly connected one to each other, forming two parallel, U-shaped channels.

The panel fastener device of U.S. Pat. No. 2,607,971 uses small attaching clips, U-shaped with inwardly extending teeth. The flat panel with bents side walls is inserted straightforward into the attaching clips and fixed by said teeth. The fastener device needs a lot of different, small pieces to fasten one panel sheet and therefore is expensive in practice.

U.S. Pat. No. 4,063,393 describes a further device for assembling a panel. This device uses flat panel sheets with differently pre-formed edges. These edges securely join and fix the panels at walls of different constructions.

SUMMARY OF THE INVENTION

On the background of this prior art, it is the object of the present invention to provide a device which is capable of receiving a variety of cladding panels in a simple manner and essentially without visible fastening elements, in particular allowing the attachment of different casings and panellings, which is economical in manufacture, and which ensures a constant fastening condition over years. This object is attained by means of a profile bar wherein each of the two clamping channels comprises at least three clamping edges, and wherein the clamping edges are distributed on both sides of the clamping channels, staggered in depth, and their mutual distances are so adjusted to the thickness of the side walls of the flat objects, in particular, the clamping edges are so disposed that the side walls which are inserted in one of the channels in a straight manner are automatically maintained.

BRIEF DESCRIPTION OF THE DRAWINGS

The invention will be explained in more detail hereinafter with reference to a drawing of embodiments.

DETAILED DESCRIPTION OF THE INVENTION

Figure 1:
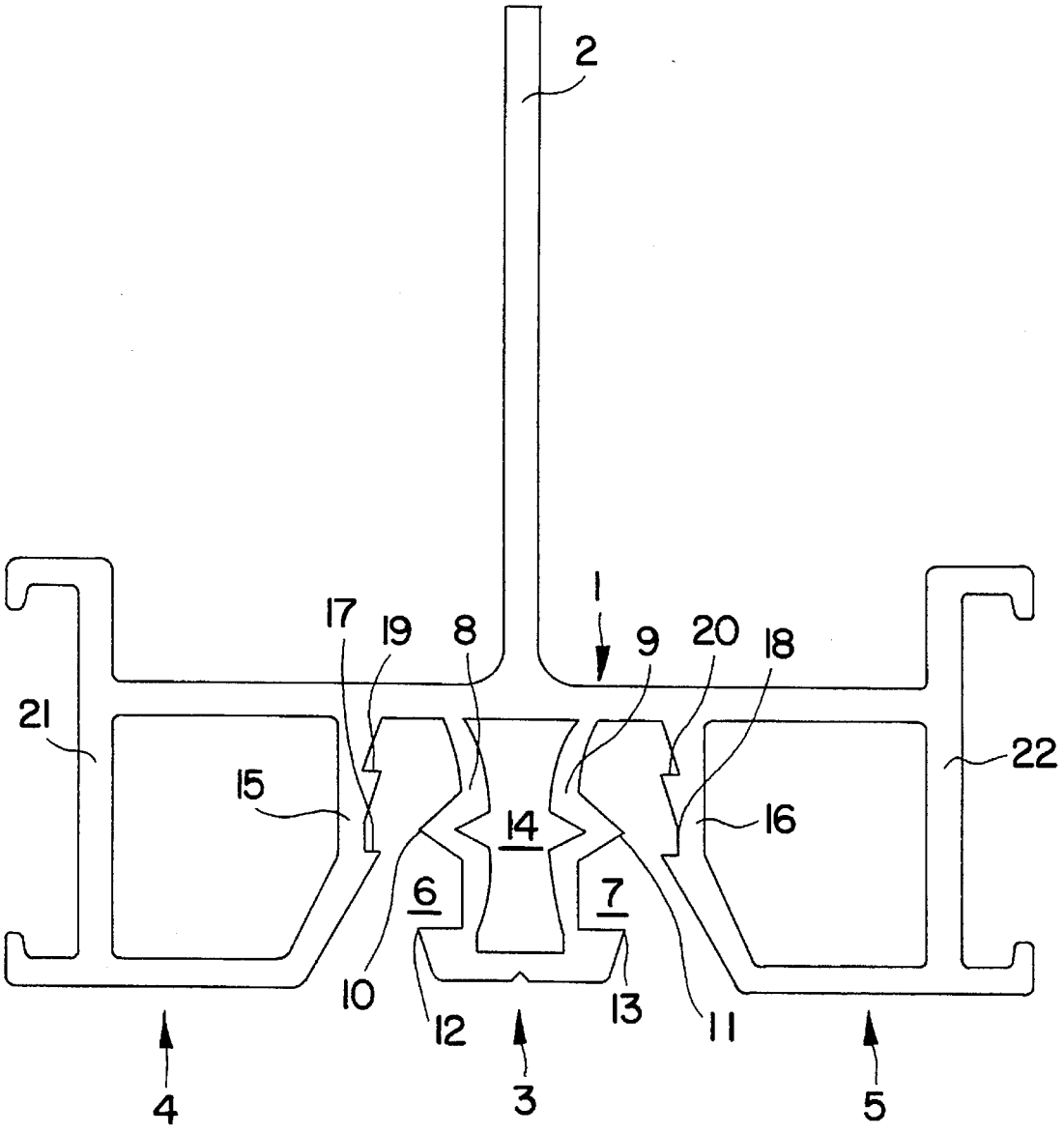
FIG. 1 shows a first embodiment of the invention in a plan view.
Figure 6:
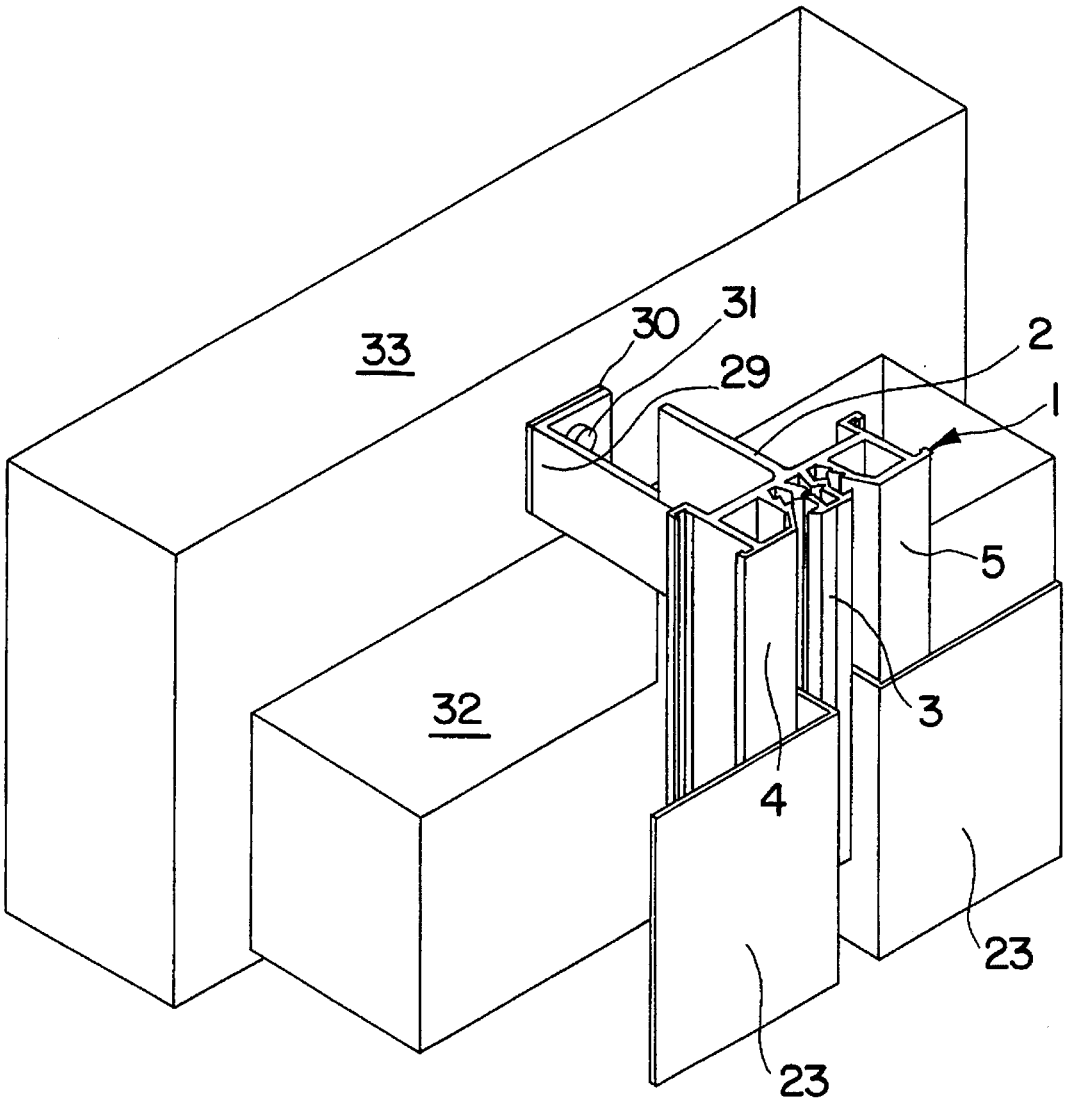
FIG. 6 shows the use of the device according to FIG. 1 on a static underground in a perspective view and in partial section.

FIG. 1 shows the profile bar 1 of the invention in a plan view, see also FIG. 6. This profile bar is intended for the attachment of cladding panels, as shown e.g. in FIG. 6, and is provided in this case with one or several mounting flanges 2 of various designs which may be omitted if an apparatus construction or a mounting rail is concerned. The profile bar 1 comprises a center profile 3 and an adjoining lateral profile 4 and 5 on each side of the center profile. A continuous clamping channel 6 and 7 is formed between each of the two lateral profiles and the center profile. The profile bar may also have a number of clamping channels which is different from two.

The width of the channels, and the shape of the channel cross-section is such that the obtained clamping effect is sufficient to maintain the sides of cladding panels inserted therein according to FIGS. 2 –6 or the lateral flanges an apparatus without the need for additional fastening means. Different measures have been taken to obtain this strong clamping effect. A first measure consists in the fact that all three profiles are in the form of hollow profiles, whereby a spring action of the involved walls is obtained due to the elasticity of the material, e.g. an extruded aluminium alloy. A second measure consists in the design of the two clamping walls.

The symmetrical center profile 3 has two clamping walls 8 and 9 each of which comprise a symmetrical central clamping edge 10 and 11 respectively and an unsymmetrical external clamping edge 12 and 13, the two external clamping edges serving as a guiding for the corresponding portion of the clamped object rather than for the proper clamping action. The cavity 14 of the center profile laterally extends into the two central clamping edges 10 and 11, so that these two clamping edges are not constituted of a solid profile but a better spring action is obtained due to the cavity formed therein. This clamping action is further assisted by the inwardly convex shape of clamping walls 8 and 9.

The two lateral clamping walls 15 and 16 of the two lateral profiles 4 and 5 are disposed opposite the two clamping walls 8 and 9 respectively. The lateral clamping walls 15 and 16 are provided with asymmetrical, barb-like first clamping edges 17, 18 and second clamping edges 19, 20 which are staggered with respect to clamping edges 10 and 11. The second clamping edges 19 and 20 are thus disposed at a distance inward from the central clamping edges 10 and 11, i.e. in the direction of mounting flange 2. Together, the central clamping edges 10, 11 and their associated first and second clamping edges 17, 19 and 18, 20 respectively form a respective clamp in the manner of a three-point rest whose guiding action is further reinforced by the external clamping edges 12, 13 of center profile 3.

Lateral profiles 4 and 5 are approximately square in cross-section, each of the clamping walls 15, 16 being bevelled outward from central clamping edge 10, 11, i.e. away from center profile 3 so as to form a funnel. On the outside of each lateral profile 4, 5, a C-shaped mounting profile 21 and 22 respectively is provided in order to receive other parts.

It is advantageous to manufacture the profile bar from aluminium or an aluminium alloy according to the extrusion process, but the invention is neither limited to this method of manufacture nor to this material.

If the distance or rather the clear width between the different, spatially staggered clamping edges i.e., between 10, 12, and 17, 19 and between 11, 13, and 18, 20 is a little smaller than the thickness of the inserted flat object, the clamping action is in many cases sufficient for an attachment. Two elastic effects having a relatively long stroke are then combined. In the first place, it is the described spring action of the hollow center profile 3, and on the other hand, an elastic bending moment of the cladding panel which is clamped between three or more clamping edges. A further effect for a stable attachment of the element is obtained by the barb-like shape of clamping edges 17, 19 and 18, 20.

Figure 2:
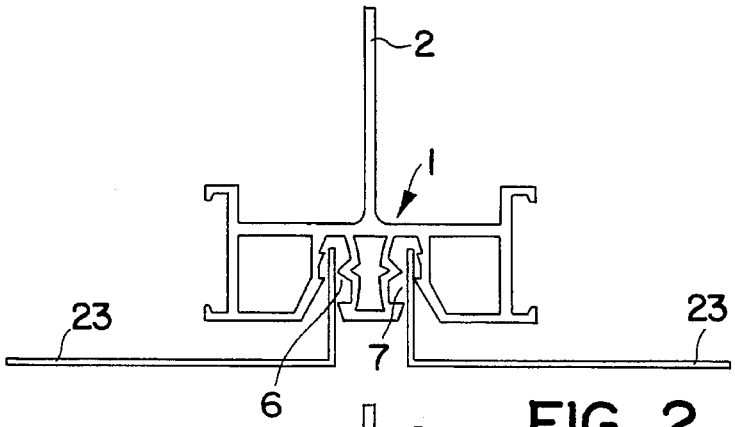
FIGS. 2 to 5 show four different possible applications of the fastening device for cladding panels.
Figure 3:
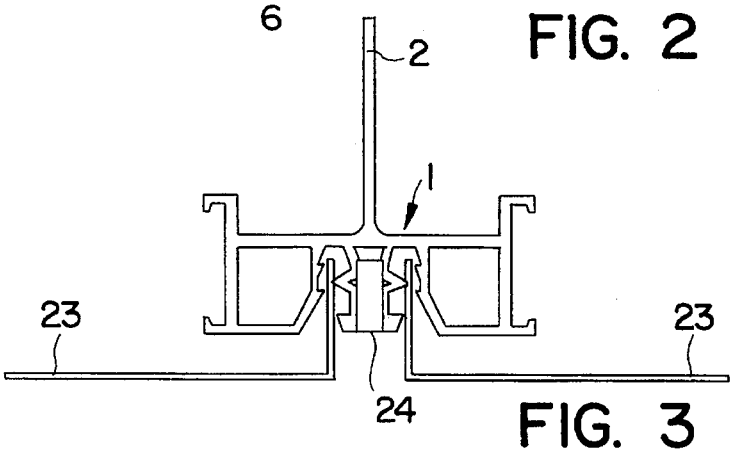
Figure 4:
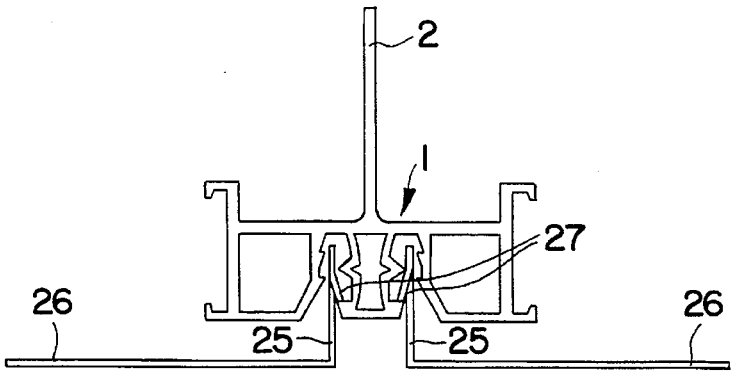
Figure 5:
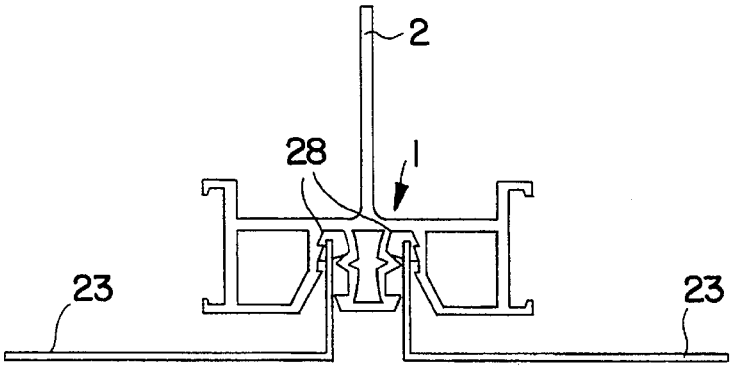

If the clamping effect is insufficient or if an additional safety for the attached elements is necessary, e.g. because the distance or the clear width between the clamping edges is greater than the thickness of the inserted flat object, FIGS. 2–5 indicate four different possibilities for an additional fastening. FIG. 2 shows that the simple insertion of cladding panels 23 into the clamping channels 6, 7 already results in a sufficient fastening of said panels in many applications. FIG. 3 shows that the cladding panels 23 may be additionally or exclusively fastened by inserting a fastening screw 24 into center profile 3 transversally to the plane connecting edges 10 and 11 at certain intervals. This results in a force which spreads the central clamping edges 10 and 11 apart. The clamping action of clamping channels 6, 7 is thus substantially increased. In FIG. 4, another alternative for fastening cladding panels is represented wherein the side walls 25 of elements 26 have cams or barbs 27 which engage behind the suitably undercut outer clamping edges 12, 13 in order to secure cladding panels 23 in profile bar 1. FIG. 5 shows another alternative where the cladding panels 23 are cemented in by means of a cement 28.

As already mentioned in the introduction, the invention is not limited to the attachment of cladding panels. Instead of such panels, flanges, side walls, panels, flat parts or shanks of apparatus or the like can be inserted into clamping channels 6, 7 in order to fasten them. In the case of apparatus which generally uses profile bar 1 as a constructive rib, other mounting flanges or other connecting means are provided in order to fasten the profile bar to the wall or another constructive element.

FIG. 6 shows the attachment of clamped cladding panels 23 in profile bar 1 on a supporting construction which is mounted on the static underground 33 of a building in a perspective view and in partial cross-section. Mounting flange 2 of profile bar 1 is fastened to a mounting piece 29 which is anchored in the static underground e.g. by a screw 31 on an insulating layer 30. An insulating layer 32 is disposed behind the cladding panels.

As follows from the above description, the fastening device of the invention is perfectly suitable for an attachment of cladding panels or apparatus casings or the like on a supporting construction without any visible fastening elements. In a large number of cases, this attachment can be effected very easily by simply clamping in the profile bar, the possibly required additional fastening measures being easy to perform, e.g. by inserting screws 24 in the bores provided for this purpose or by applying some cement 28 to the inserted portions. It is not necessary to use the exact profile of FIG. 1 in order to obtain the appropriate and required clamping action of channels 6 and 7. It is sufficient to provide at least two clamping edges, i.e. a respective edge on one clamping wall and another edge on the cooperating second clamping wall.

I claim:

1. A profile bar comprises a center profile and two lateral profiles rigidly connected to each other, said center and lateral profiles are spaced to form two parallel, U-shaped clamping channels with at least one clamping edge on each side of each said channel for holding a substantially flat object that may be inserted in any of said channels, wherein said profiles are hollow profiles.

2. The profile bar of claim 1, wherein said clamping edges situated on the channel sides formed by said center profile are formed as hollow profiles together with said center profile.

3. The profile bar of claim 2, wherein said center profile is designed in such a manner that the distance between clamping edges disposed on opposite sides of said center profile may be increased by a force acting transversely to a connecting said clamping edges disposed on opposite sides of said center profile.

4. The profile bar of claim 3, wherein screws and associated threads in said center profile are provided in order to produce said force.

5. The profile bar of claim 2, wherein said clamping edges situated on the sides of said channels that are formed by said center profile correspond to two clamping edges formed on each of the two sides of said channels that are formed by said lateral profiles, wherein the placement of said corresponding clamping edges is staggered.

6. The profile bar of claim 5, wherein said clamping edges situated on the sides of said channels formed by said lateral profiles have a barb-shaped design.

7. The profile bar of claim 1, wherein said lateral profiles each comprise an external, C-shaped fastening profile located on the side of each said lateral profile opposite the side forming a side of said channels.

8. The profile bar of claim 1, wherein a mounting flange is provided for mounting said profile bar.

9. The profile bar of claim 1, wherein an extrudable aluminum alloy is used for its manufacture.

10. The combination of the profile bar of claim 5, and at least one substantially flat object;

wherein at least one of said clamping edges of said clamping channels is designed in such a manner that barbs provided on said sides of said substantially flat object are engageable behind at least one of said clamping edges.

11. The combination as claimed in claim 10, wherein said substantially flat object is a cladding panel.

12. A profile bar comprising a plurality of profiles rigidly connected to each other, said profiles being spaced to form at least one U-shaped clamping channel with at least one clamping edge on each side of said at least one channel for holding a substantially flat object that may be inserted in said at least one channel, wherein at least two of said plurality of profiles are hollow.

13. The profile bar of claim 12, wherein said clamping edges situated on the sides of said at least one channel, formed by said plurality of profiles, are formed as hollow profiles together with said plurality of profiles.

14. The profile bar of claim 13, wherein at least one of the plurality of profiles is designed in such a manner that the distance between clamping edges disposed on opposite sides of said at least one of the plurality of profiles may be increased by a force acting transversely to the plane connecting said clamping edges.

15. The profile bar of claim 14, wherein screws and associated threads in said profile are provided in order to produce said force.

16. The profile bar of claim 15, wherein said clamping edges situated on one side of said at least one channel correspond to two clamping edges formed on the other side of said at least one channel, wherein the placement of said corresponding clamping edges is staggered.

17. The profile bar of claim 16, wherein said some of said clamping edges situated on the sides of said channels formed by said profiles have a barb-shaped design.

18. The profile bar of claim 12, wherein any side of a profile of said plurality of profiles which does not face an adjacent profile comprises an external, C-shaped fastening profile.

19. The profile bar of claim 12, wherein an extrudable aluminum alloy is used for its manufacture.

* * * * *

UNITED STATES PATENT AND TRADEMARK OFFICE

CERTIFICATE OF CORRECTION

PATENT NO. : 5,579,624
DATED : December 3, 1996
INVENTOR(S) : Max AEBERHARD

It is certified that error appears in the above-indentified patent and that said Letters Patent is hereby corrected as shown below:

In column 4, line 37, --plane-- should be inserted before "connecting."

Signed and Sealed this

Eighteenth Day of March, 1997

*Attest:*

*Attesting Officer*

BRUCE LEHMAN

*Commissioner of Patents and Trademarks*